US009161626B2

(12) United States Patent
Zimmermann

(10) Patent No.: US 9,161,626 B2
(45) Date of Patent: Oct. 20, 2015

(54) DRAWER GUIDE

(71) Applicant: Schock Metallwerk GmbH, Urbach (DE)

(72) Inventor: Joachim Zimmermann, Schorndorf (DE)

(73) Assignee: Schock Metallwerk GmbH, Urbach (DE)

( * ) Notice: Subject to any disclaimer, the term of this patent is extended or adjusted under 35 U.S.C. 154(b) by 0 days.

(21) Appl. No.: 14/100,086

(22) Filed: Dec. 9, 2013

(65) Prior Publication Data

US 2014/0152165 A1 Jun. 5, 2014

Related U.S. Application Data

(63) Continuation of application No. PCT/EP2012/061112, filed on Jun. 12, 2012.

(30) Foreign Application Priority Data

Jun. 17, 2011 (DE) ..... 10 2011 051 138

(51) Int. Cl.

| | |
|---|---|
| ***A47B 88/04*** | (2006.01) |
| ***A47B 88/16*** | (2006.01) |
| ***A47B 88/10*** | (2006.01) |
| ***E05B 65/44*** | (2006.01) |

(52) U.S. Cl.

CPC ..... *A47B 88/16* (2013.01); *A47B 88/10* (2013.01); *E05B 65/44* (2013.01); *A47B 2210/0016* (2013.01); *A47B 2210/0032* (2013.01); *A47B 2210/0059* (2013.01)

(58) Field of Classification Search

CPC ..... A47B 88/10; A47B 88/16; A47B 88/04; A47B 2210/0016; A47B 2210/0018; A47B 2210/0059; A47B 2210/0081; E05B 65/44

USPC ..... 312/330.1, 333, 334.1, 334.44, 334.46

See application file for complete search history.

(56) References Cited

U.S. PATENT DOCUMENTS

| | | | | |
|---|---|---|---|---|
| 3,039,838 | A * | 6/1962 | Koch, Jr. et al. | 384/21 |
| 3,857,618 | A | 12/1974 | Hagen et al. | |
| 4,469,384 | A * | 9/1984 | Fler et al. | 312/333 |
| 4,799,802 | A | 1/1989 | Lautenschlager | |
| 5,181,782 | A | 1/1993 | Wojcik | |
| 5,207,781 | A | 5/1993 | Röck | |
| 5,417,489 | A | 5/1995 | Compagnucci | |

(Continued)

FOREIGN PATENT DOCUMENTS

| | | |
|---|---|---|
| DE | 30 05 817 | 9/1980 |
| DE | 691 05 678 | 4/1995 |

(Continued)

*Primary Examiner* — James O Hansen
(74) *Attorney, Agent, or Firm* — Lipsitz & McAllister, LLC

(57) ABSTRACT

A drawer guide is provided for a drawer configured to be pulled out of a carcass in a pull-out direction. The drawer guide has at least two guide rails displaceable relative to one another, and a locking device for locking at least one of the at least two guide rails relative to at least one further one of the at least two guide rails with respect to the pull-out direction. The locking device has at least one locking element and at least one locking element receiver to receive the at least one locking element, which are arranged on different guide rails. The at least one locking element receiver has at least two receiver portions, between which at least one locking element is receivable in a locked state of the drawer guide.

15 Claims, 13 Drawing Sheets

(56) References Cited

U.S. PATENT DOCUMENTS

| | | | | |
|---|---|---|---|---|
| 5,951,132 | A * | 9/1999 | Cirocco | 312/334.46 |
| 6,244,678 | B1 * | 6/2001 | Dopp et al. | 312/333 |
| 6,789,861 | B1 | 9/2004 | Dobberstein | |
| 6,789,862 | B2 * | 9/2004 | Shih-Long et al. | 312/334.46 |
| 6,854,379 | B2 | 2/2005 | Pattle et al. | |
| 6,942,307 | B1 | 9/2005 | Lammens | |
| 7,316,179 | B2 | 1/2008 | Geberzahn et al. | |
| 7,384,108 | B2 | 6/2008 | Lam et al. | |
| 7,641,296 | B2 | 1/2010 | Le | |
| 7,798,583 | B2 * | 9/2010 | Yang et al. | 312/334.46 |
| 7,845,744 | B2 | 12/2010 | Chen et al. | |
| 7,942,486 | B2 | 5/2011 | Petri | |
| 8,827,388 | B2 | 9/2014 | Johansson et al. | |
| 2002/0033658 | A1 | 3/2002 | Salice | |
| 2003/0006682 | A1 | 1/2003 | Hoffman | |
| 2003/0067257 | A1 | 4/2003 | Gasser | |
| 2003/0079615 | A1 | 5/2003 | Pattle et al. | |
| 2003/0209958 | A1 | 11/2003 | Hwang et al. | |
| 2004/0000850 | A1 | 1/2004 | Lam Harn et al. | |
| 2004/0003726 | A1 | 1/2004 | Geberzahn et al. | |
| 2005/0074190 | A1 | 4/2005 | Traiser et al. | |
| 2007/0126324 | A1 | 6/2007 | Lee | |
| 2007/0222346 | A1 | 9/2007 | Kleinsasser | |
| 2007/0261199 | A1 | 11/2007 | Petri | |
| 2008/0284299 | A1 | 11/2008 | Chen et al. | |
| 2010/0296758 | A1 | 11/2010 | Johansson | |
| 2011/0142380 | A1 | 6/2011 | Jeakings | |
| 2013/0026899 | A1 | 1/2013 | Babucke-Runte et al. | |
| 2014/0021840 | A1 | 1/2014 | Radusin | |

FOREIGN PATENT DOCUMENTS

| | | |
|---|---|---|
| DE | 694 06 715 | 6/1998 |
| DE | 103 40 482 | 4/2005 |
| DE | 20 2005 013 789 | 12/2005 |
| DE | 10 2004 057 714 | 6/2006 |
| DE | 10 2005 002 315 | 7/2006 |
| DE | 10 2006 057 582 | 7/2007 |
| DE | 10 2006 007 978 | 8/2007 |
| DE | 20 2007 011 533 | 12/2007 |
| DE | 199 11 312 | 2/2008 |
| DE | 20 2008 000 887 | 4/2008 |
| DE | 20 2006 019 009 | 5/2008 |
| DE | 10 2010 036 902 | 2/2011 |
| DE | 20 2011 051 895 | 1/2012 |
| DE | 10 2010 043 422 | 5/2012 |
| DE | 10 2011 004 889 | 9/2012 |
| EP | 0 476 745 | 3/1992 |
| EP | 0 626 143 | 11/1994 |
| EP | 1 225 806 | 4/2004 |
| EP | 1 327 109 | 12/2004 |
| EP | 1 306 622 | 9/2005 |
| EP | 1 243 203 | 8/2006 |
| EP | 1 277 422 | 10/2006 |
| EP | 1 502 521 | 10/2006 |
| EP | 1 571 357 | 8/2007 |
| EP | 1 607 685 | 8/2007 |
| EP | 1 662 159 | 3/2010 |
| EP | 2 160 960 | 3/2010 |
| EP | 1 532 402 | 12/2010 |
| EP | 2 325 565 | 5/2011 |
| EP | 1 642 066 | 10/2011 |
| EP | 2 487 422 | 8/2012 |
| EP | 2 532 273 | 12/2012 |
| EP | 2 532 976 | 12/2012 |
| JP | 2010 104735 | 5/2010 |
| JP | 2011024665 | 2/2011 |
| WO | WO 2006/000523 | 1/2006 |
| WO | WO 2007/111424 | 10/2007 |
| WO | WO 2009/150434 | 12/2009 |
| WO | WO 2010/089553 | 8/2010 |
| WO | WO 2012/025717 | 3/2012 |

* cited by examiner

DRAWER GUIDE

RELATED APPLICATION

This application is a continuation of International application No. PCT/EP2012/061112 filed on Jun. 12, 2012 and claims the benefit of German application number 10 2011 051 138.5 filed on Jun. 17, 2011, which are incorporated herein by reference in their entirety and for all purposes.

FIELD OF DISCLOSURE

The present invention relates to a drawer guide for displaceably arranging, on a carcass, a drawer configured to be pulled out of the carcass in a pull-out direction, comprising at least two guide rails, which are displaceable relative to one another, and a locking device for locking at least one of the at least two guide rails relative to at least one further one of the at least two guide rails with respect to the pull-out direction in at least one position, wherein the locking device comprises at least one locking element and at least one locking element receiver to receive the at least one locking element, which are arranged on guide rails of the drawer guide, which are different from one another.

BACKGROUND

Drawer guides of this type may, for example, be provided with a locking device configured as a latching device, one of the at least two guide rails being provided with a latching lug and a further one of the at least two guide rails being provided with a latching recess and the latching lug being configured to be made to engage with the latching recess to lock the guide rails relative to one another with respect to the pull-out direction. The forces necessary for latching and/or unlatching, however, then depend in particular on a production precision of the drawer guide. For example, a desired latching force can no longer be ensured when too great a clearance prevails between the guide rails or is produced during the course of time by the use of the drawer guide, so the latching lug is no longer configured to be made to engage in the desired manner with the latching recess.

SUMMARY OF THE INVENTION

The present invention is based on the object of providing a drawer guide of the type mentioned at the outset, which allows reliable locking of at least two guide rails relative to one another.

This object is achieved according to the invention in that at least one locking element receiver comprises at least two receiver portions, between which at least one locking element is receivable in a locked state of the drawer guide, at least two receiver portions being arranged with respect to a relative movement path of at least one locking element, on mutually opposite sides of the relative movement path relative to at least one locking element receiver.

Since, according to the invention, at least two receiver portions of at least one locking element receiver are arranged on mutually opposite sides of the relative movement path with respect to the relative movement path of at least one locking element, the at least one locking element can be enclosed from both sides and therefore received between the receiver portions, so the forces acting when the at least one locking element is received between the at least two receiver portions are substantially independent of production tolerances in the production of the guide rails.

In particular, it can be provided that at least one locking element receiver is configured in such a way that owing to a movement of the at least one locking element and/or at least one locking element receiver in or counter to the pull-out direction, at least one locking element, in a direction running transversely, in particular perpendicularly, to the pull-out direction of the drawer guide, is receivable between at least two receiver portions of a locking element receiver. At least two receiver portions in the locked state of the drawer guide are preferably arranged on both sides of at least one locking element with regard to the pull-out direction, wherein an arrangement "on both sides of at least one locking element" should be taken to mean an arrangement of the receiver portions to the right and left of the relative movement path of the locking element to be received and/or an arrangement of the receiver portions above the relative movement path, in particular over the relative movement path, and below the relative movement path, in particular under the relative movement path of the locking element to be received.

A relative movement path of a locking element relative to at least one locking element receiver, in this description and the accompanying claims, is to be taken to mean the path, along which the relevant locking element is movable relative to at least one locking element receiver to lock the drawer guide, in other words to lock one of the at least two guide rails relative to at least one further one of the at least two guide rails with respect to the pull-out direction in at least one position. In this case, exclusively the relative movement is decisive, so a locking element does not inevitably have to be movable, but can also be stationary, as long as at least one locking element receiver is then configured to be movable.

It may be advantageous if the drawer guide comprises at least three guide rails, namely a carcass-side rail, which, in the assembled state of the drawer guide, faces a carcass of a piece of furniture, in particular is rigidly connected to the carcass, a drawer-side rail, which, in the assembled state, faces a drawer configured to be pulled out of the carcass, in particular is rigidly connected to the drawer in the assembled state of the drawer guide on the drawer, and at least one centre rail arranged between the carcass-side and the drawer-side guide rail. A full-extension mechanism can be formed, in particular, by means of an at least three-rail drawer guide.

However, the drawer guide, in an alternative configuration, can also comprise only two guide rails that are displaceable relative to one another, namely a carcass-side and a drawer-side guide rail, whereby a partial-extension mechanism can be formed.

In one configuration of the invention it is provided that at least one locking element is movably arranged on a guide rail in a direction running transversely to the pull-out direction, in particular in a direction running substantially perpendicularly to the pull-out direction. In this manner, manufacturing tolerances can be particularly simply compensated during the production of the locking device and/or the guide rails.

In particular, it may be provided here that at least one locking element is linearly displaceable and/or pivotable about an axis running, for example, parallel to the pull-out direction.

The term "pivotable" is to be taken to mean, in this description and the accompanying claims, any type of rotational movement about an axis, in particular a resilient deflection, which preferably results from an inherent elasticity of a component and allows a resilient deflection of a part of the component.

At least one locking element is preferably a separate element, in other words an element that is different from the guide rail and which is arranged on a guide rail and projects away therefrom.

In one configuration of the invention, at least one locking element and/or at least one locking element receiver is formed from the same or the identical material as at least one guide rail. For example, it may be provided that at least one locking element, at least one locking element receiver and/or at least one guide rail is formed from steel.

It may be advantageous if at least one locking element and/or at least one locking element receiver is formed from a material that is different from the material of the guide rails.

Thus, it may, for example, be provided that at least one guide rail, in particular all the guide rails, comprise a metallic material, in particular steel, or are formed from metal, in particular from steel.

At least one locking element is formed, for example, from a metallic material, in particular from steel, or from a plastics material, for example by an injection moulding method and arranged on the guide rail, in particular displaceably.

At least one locking element is preferably configured, at least in portions, in the form of a cylinder or cone. In this manner, the at least one locking element can be particularly easily received between at least two receiver portions of at least one locking element receiver.

It may be favourable if at least one locking element receiver is movably arranged on one of the guide rails in a direction running transversely to the pull-out direction, in particular in a direction running substantially perpendicularly to the pull-out direction.

In particular, it may be provided that at least one locking element receiver is displaceably arranged and/or pivotably arranged about an axis running, for example, substantially parallel to the pull-out direction on one of the guide rails.

At least one guide rail preferably comprises a rail back, which connects two legs of the guide rail to one another, which each have a rolling element track. The guide rail is therefore preferably substantially C-shaped.

It may be advantageous if at least one locking element receiver is arranged on a rail back of a guide rail, which rail back connects two legs of the guide rail to one another, which legs in each case have a rolling element track.

As an alternative or in addition to this, it may be provided that at least one locking element is arranged on a rail back of a guide rail, which rail back connects two legs of the guide rail to one another, which legs in each case have a rolling body track.

In one configuration of the invention it is provided that at least one locking element is arranged on a leg, which has a rolling element track, of a substantially C-shaped guide rail.

Alternatively or in addition to this, it may be provided that at least one locking element receiver is arranged on a leg, which has a rolling element track, of a substantially C-shaped guide rail.

At least one locking element receiver is preferably formed in one piece. A particularly stable locking element receiver that is easy to produce can thus be provided.

At least one locking element may also preferably be formed in one piece.

At least one locking element receiver preferably comprises a metallic material or is formed from metal. It can thus, in particular, be provided that at least one locking element receiver comprises a sheet metal bent product.

It may be particularly favourable if at least one locking element receiver is configured as a sheet metal bent product. A particularly stable locking element receiver can thus be provided.

Alternatively or in addition to this, it may be provided that at least one locking element receiver is configured to be multi-part. Thus, for example, it may be provided that one element for arranging at least one locking element receiver on the guide rail is formed from a metallic material and at least one receiver portion of the at least one locking element receiver is formed from a plastics material, in particular is formed as an injection-moulded component.

In one configuration of the invention it is provided that at least one locking element and at least one locking element receiver are arranged on at least two of the at least two guide rails in such a way that the drawer guides are lockable in an at least approximately completely pulled-out position and/or in an at least approximately completely inserted position. In this manner, a drawer, which is held on a carcass of a piece of furniture by means of the drawer guide according to the invention, can be locked in the at least approximately completely inserted state, so the drawer cannot undesirably slide out of the carcass. Furthermore, the drawer can preferably be locked in at least one at least approximately completely pulled-out position in order to particularly easily access a content of the drawer, without the drawer undesirably sliding back into the carcass.

In particular, it may be provided that at least one locking element receiver and at least two locking elements are provided, the at least two locking elements being arranged in mutually opposite end regions of a guide rail with respect to the pull-out direction and the at least one locking element receiver being arranged in the end region of a further guide rail located at the front in the pull-out direction.

In this manner, the at least one locking element receiver can be made to selectively engage with one of the locking elements in each case to latch in the completely pulled-out position and/or in the completely inserted position.

At least one locking element is preferably arranged on a carcass-side guide rail or on a drawer-side guide rail. At least one locking element receiver is then preferably arranged on a drawer-side guide rail or on a carcass-side guide rail.

It may be favourable if at least one receiver portion of at least one locking element receiver is resiliently pivotable about an axis running at least approximately perpendicularly to the pull-out direction.

In particular, it can be provided that a resilient deflection of at least one receiver portion is possible in that a receiver portion of a component is resiliently pivotable because of an inherent elasticity of the component.

At least two receiver portions, which are arranged mutually opposite with respect to a relative movement path of at least one locking element, of at least one locking element receiver are preferably, in each case, pivotable about an axis, the axes running at least approximately parallel to one another. In this manner, at least one locking element can be particularly reliably received between two mutually opposing receiver portions, because this preferably prevents forces from acting between the guide rails by means of the receiver portions and the at least one locking element.

At least two receiver portions, which are arranged opposite one another with respect to a relative movement path of the at least one locking element, of at least one locking element receiver to receive at least one locking element are preferably movable at least approximately along directions running in the same plane, in particular linearly movable in opposite directions, for example resiliently linearly movable, or (resiliently) pivotable about an axis in each case.

In particular, it may be provided that the restoring forces resulting from a deflection of at least two receiver portions arranged mutually opposing act in directions running at least approximately in the same plane.

The plane, along which the directions run, in which preferably at least two receiver portions arranged mutually opposing are movable, runs, in particular, substantially parallel to the pull-out direction.

It may be advantageous if at least two receiver portions, which are arranged mutually opposite with respect to a relative movement path of at least one locking element, of at least one locking element receiver, to receive at least one locking element, are movable at least approximately along directions running in a common movement plane, the movement plane running at least approximately perpendicularly to a rail plane, along which a rail back of a C-shaped guide rail extends.

The movement plane is, for example, substantially horizontally oriented when the rail back of the C-shaped guide rail is substantially vertically oriented. Furthermore, it may be provided that the movement plane is substantially vertically oriented when the rail back of the C-shaped guide rail is substantially horizontally oriented.

Alternatively or in addition to this, it may be provided that at least two receiver portions, which are arranged mutually opposite with respect to the relative movement path of the at least one locking element, of at least one locking element receiver, to receive the at least one locking element, are movable at least approximately along directions running in a common movement plane, the movement plane running at least approximately parallel to a rail plane, along which a rail back of a C-shaped guide rail extends.

In particular, it may be provided that both the movement plane and the rail plane are oriented substantially vertically or substantially horizontally.

In one configuration of the invention it is provided that at least two locking elements and/or at least two locking element receivers are provided, which differ from one another with respect to a locking force necessary to achieve the locked state of the drawer guide and/or with respect to a clamping force acting in the locked state of the drawer guides and/or with respect to a release force necessary to release the locked state of the drawer guide. In this manner, it may be provided that different forces have to be applied in order to insert the drawer held on a carcass by means of the drawer guide according to the invention from a pulled-out state or to pull it out from an inserted state.

A "locking force", in this description and the accompanying claims, is taken to mean that force, which has to be overcome in order to make a locking element engage with a locking element receiver.

A "clamping force", in this description and the accompanying claims, is taken to mean that force, which, in the locked state of the drawer guide, is exerted by the locking element receiver on the locking element received therein.

A "release force", in this description and the accompanying claims, is taken to mean that force, which has to be overcome in order to make the locking element disengage from the locking element receiver.

The locking force, the clamping force and/or the release force preferably result from restoring forces of resiliently mounted receiver portions.

Furthermore, the drawer guide according to the invention may have the following features and/or advantages:

In one configuration of the invention it may be provided that at least one locking device is configured in such a way that the drawer guide can be locked in a completely inserted position and in a completely pulled-out position, wherein different forces (with respect to the respective amounts of the forces) preferably have to be applied to achieve the locked position in the completely inserted state, to release the locked position in the completely inserted state, to achieve the locked position in the completely pulled-out state and/or to release the locked position in the completely pulled-out state.

The drawer guide according to the invention can provide the advantage that across large temperature ranges, substantially constant forces are present during the operation of the drawer guide, for example constant locking forces, constant clamping forces and/or constant release forces, wherein a constant force in this sense should be taken to mean that the maximally acting force when carrying out a locking process, during the clamping and/or during the release of the lock is substantially independent of temperature.

Basically, it may be provided that at least one locking element is formed as a projection on a leg of a guide rail and is therefore formed in one piece with the guide rail.

As an alternative or in addition to this, it may be provided that at least one locking element is produced separately from the at least one guide rail and is welded or latched to the at least one guide rail.

At least one locking element receiver is preferably substantially C-shaped and thus, in the locked state, engages around at least one locking element. The at least one locking element receiver therefore, for example, forms a tong element, which, in the locked state, can receive at least one locking element.

The drawer guide according to the invention can provide the advantage that a tolerance in the movement of at least one locking element relative to at least one locking element receiver is substantially independent of a clearance between the at least two guide rails and substantially only depends on a material thickness of the at least one locking element and the production tolerance in the production of the at least one locking element receiver.

Further features and advantages of the invention are the subject of the following description and the graphical view of embodiments.

BRIEF DESCRIPTION OF THE DRAWINGS

The same or functionally equivalent elements are provided with the same reference numerals in all the figures.

DETAILED DESCRIPTION OF THE DRAWINGS

Figure 1:
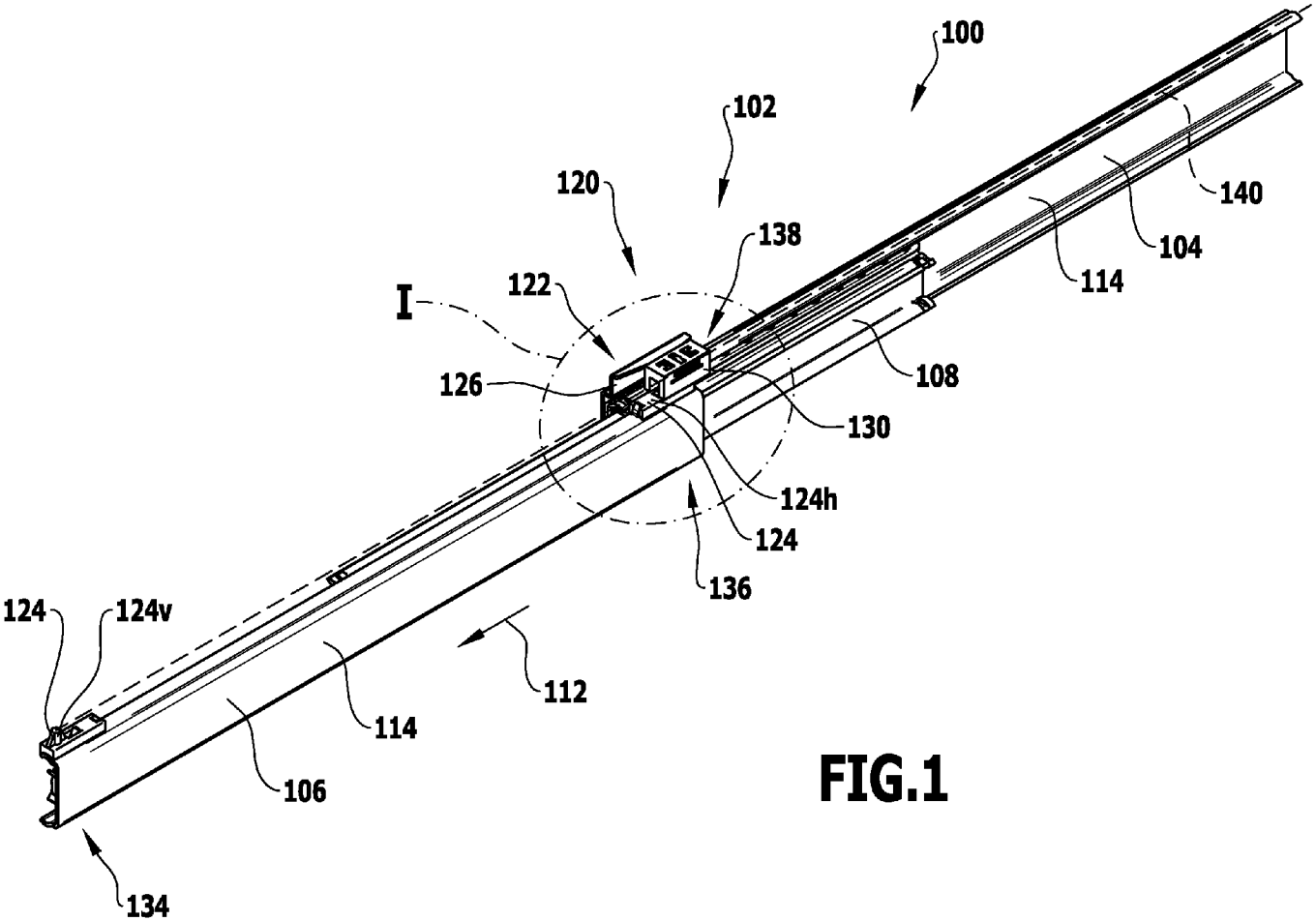
FIG. 1 shows a schematic perspective view of a first embodiment of a drawer guide, which comprises a locking device with a locking element receiver comprising a tong element made of plastics material.

A first embodiment of the drawer guide designated 100 as whole and shown in FIGS. 1 to 5 comprises three guide rails 102, namely a carcass-side guide rail 104, which, in the assembled state of the drawer guide 100 is arranged on a carcass (not shown), a drawer-side guide rail 106, which, in the assembled state of the drawer guide 100, is arranged on a drawer (not shown) configured to be pulled out of the carcass, and a centre rail 108 arranged between the carcass-side guide rail 104 and the drawer-side guide rail 106.

The guide rails 102 of the drawer guide 100 are arranged displaceably on one another by means of rolling elements 110.

As a result, the drawer-side guide rail 106, in the assembled state of the drawer guide 100, can be easily pulled out of the carcass together with the drawer in a pull-out direction 112 from a completely inserted state, in which the drawer guide 100 and a drawer arranged thereon are arranged completely in the carcass.

The drawer-side guide rail 106 is therefore movable, in particular relative to the carcass-side guide rail 104, in the pull-out direction 112.

Both the drawer-side guide rail 106 and the carcass-side guide rail 104 are substantially C-shaped, each of these guide rails 104, 106 comprising a substantially vertically oriented rail back 114 in the assembled state of the drawer guide 100, which rail back comprises two legs 116 projecting away from the rail back 114 in a substantially horizontal direction, on which legs rolling element tracks 118 for the rolling elements 110 are formed.

The drawer-side guide rail 106 and the carcass-side guide rail 104 are, in particular, arranged here in such a way that the legs 116 of the drawer-side guide rail 106, proceeding from the rail back 114 of the drawer-side guide rail 106, extend in the direction of the carcass-side guide rail 104. Furthermore, the legs 116 of the carcass-side guide rail 104, proceeding from the rail back 114 of the carcass-side guide rail 104, extend in the direction of the drawer-side guide rail 106 (see, in particular, FIG. 3).

Arranged between the drawer-side guide rail 106 and the carcass-side guide rail 104 is the centre rail 108, which is substantially formed from two C-shaped rails, which are connected to one another at their rail backs 114.

Also provided on the centre rail 108 are legs 116, on which respective rolling element tracks 118 for the rolling elements 110 are formed and which project away from the rail backs 114 in the substantially horizontal direction. In the assembled state of the drawer guide 100, arranged between the legs 116 of the centre rail 108 and the legs 116 of the carcass-side guide rail 104, and between the legs 116 of the centre rail 108 and the legs 116 of the drawer-side guide rail 106 are the rolling elements 110.

As can be gathered, in particular from FIG. 1, the drawer guide 100 furthermore comprises a locking device 120, which comprises a locking element receiver 122 and a plurality of, for example two, locking elements 124.

In the first embodiment of the drawer guide 100 shown in FIGS. 1 to 5, the locking element receiver 122 of the locking device 120 is arranged on the rail back 114 of the carcass-side guide rail 104.

The locking elements 124 of the locking device 120 are arranged on an upper leg 116, with respect to the direction of gravity, of the drawer-side guide rail 106.

The locking element receiver 122 is substantially formed in two parts and comprises a holding element 126, which, for example, is formed from metal, and is arranged, for example welded, to the rail back 114 of the carcass-side guide rail 104.

Figure 2:
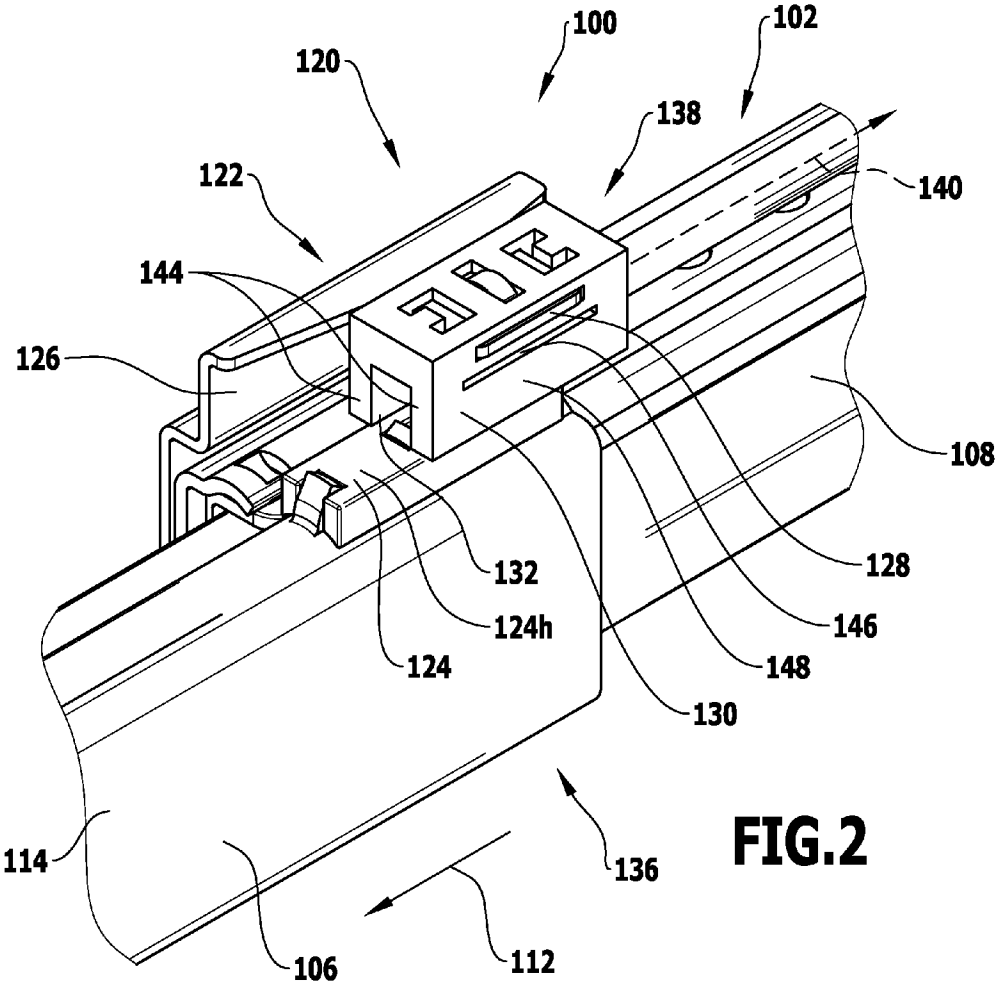
FIG. 2 shows an enlarged view of the region I in FIG. 1.

The holding element 126 projects upwardly over the guide rails 102 of the drawer guide 100 and projects with a web region 128, which can be seen, for example, in FIG. 2, of the holding element 126 in the horizontal direction and perpendicularly to the pull-out direction 112 over the drawer-side guide rail 106. Arranged on the web region 128 of the holding element 126 is a tong element 130 formed, for example, as an injection-moulded component made of a plastics material, which tong element 130 has a substantially C-shaped vertical cross-section taken perpendicularly to the pull-out direction 112 and is oriented such that the opening of the tong element 130 caused by the C-shape is directed downwardly.

Owing to the C-shaped configuration of the tong element 130, a receiver channel 132 is formed, in which a locking element 124 can be received.

The receiver channel 132 extends substantially parallel to the pull-out direction 112 of the drawer guide 100.

In the first embodiment of the drawer guide 100 shown in FIG. 1, two locking elements 124 are provided, namely a front locking element **124*v* and a rear locking element 124*h***.

The front locking element **124*v* is arranged in a front end region 134, with respect to the pull-out direction 112, of the drawer-side guide rail 106. The rear locking element 124*h* is arranged in a rear end region 136 opposite to the front end region 134 with respect to the pull-out direction 112, of the drawer-side guide rail 106**.

The locking element receiver 122 of the locking device 120 is arranged in a front end region 138 of the carcass-side guide rail 104.

In the first embodiment of the drawer guide 100 shown in FIG. 1, the locking device 120 is therefore configured in such a way that, in the at least approximately completely inserted state of the drawer guide 100, the front locking element **124*v* arranged in the front end region 134 of the drawer-side guide rail 106 is configured to be brought into engagement with the locking element receiver 122 arranged in the front end region 138 of the carcass-side guide rail 104. Therefore, the drawer-side guide rail 106 is lockable relative to the carcass-side guide rail 104 with respect to the pull-out direction 112** in the at least approximately completely inserted state.

A drawer arranged on the carcass by means of the drawer guide 100 can consequently be locked in the inserted position, so the drawer cannot undesirably slide out of the carcass.

By means of the rear locking element **124*h*, which is arranged in the rear end region 136 of the drawer-side guide rail 106, the drawer guide 100 can be locked in the completely pulled-out position by the rear locking element 124*h* being made to engage with the locking element receiver 122**.

As a result, a drawer arranged on the carcass by means of the drawer guide 100 can be locked in the pulled-out position in order to particularly easily access contents of a drawer configured for example as a complete case-type drawer, without the drawer undesirably sliding back into the carcass.

As can be gathered, in particular from FIG. 2, the rear locking element **124*h*, upon a movement of the drawer-side guide rail 106 from the completely pulled-out position counter to the pull-out direction 112, is also moved counter to the pull-out direction 112. The rear locking element 124*h* as a result moves relative to the locking element receiver 122 on a movement path designated a relative movement path 140**.

By means of a movement of the drawer-side guide rail 106 relative to the carcass-side guide rail 104, the rear locking element **124*h* and, in a corresponding manner, also the front locking element 124*v*, can therefore be moved relative to the locking element receiver 122 along a relative movement path 140**.

As an alternative to this, a movement of the locking element receiver 122 would also be possible in case of fixed locking elements 124. As a result, a relative movement path 140 of the locking element 124 relative to the locking element receiver 122 would also be adopted.

The relative movement path 140 runs substantially parallel to the pull-out direction 112. In particular, when manufacturing tolerances in the production of the guide rails 102 of the drawer guide 100 are to be compensated by means of the locking device 120, it may be provided that the locking elements 124 and/or the tong element 130 of the locking element receiver 122 are displaceable or pivotable in a direction perpendicular to the pull-out direction 112, so that it can always be ensured that the locking element 124 can be received substantially centrally in the receiver channel 132 of the locking element receiver 122 for reliable locking with respect to a direction running perpendicularly to the pull-out direction 112.

Owing to the displaceability and/or pivotability of the locking elements 124 and/or of the locking element receiver 122, small deviations in the relative movement path 140 from a direction running precisely parallel to the pull-out direction 112 can therefore be produced.

Figure 3:
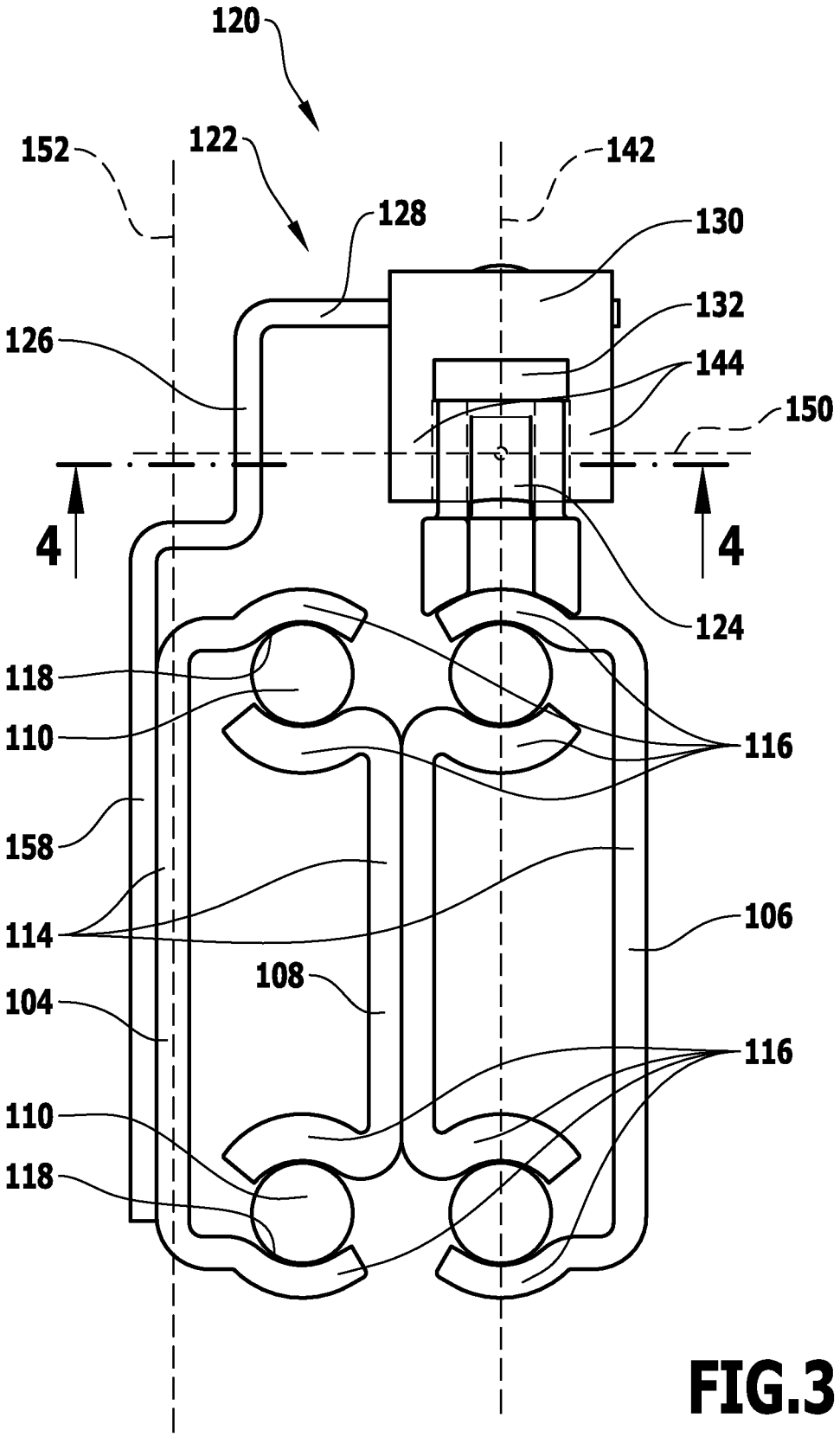
FIG. 3 shows a schematic view of a vertical cross-section through the drawer guide from FIG. 1.
Figure 4:
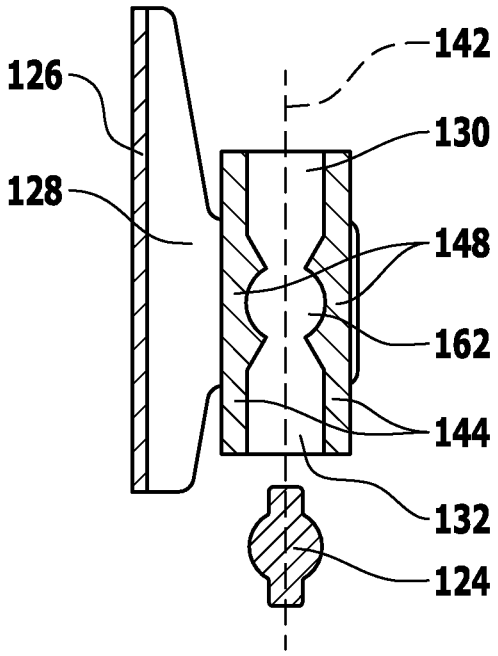
FIG. 4 shows a schematic view of a horizontal section through the locking device of the drawer guide from FIG. 1 along the line 4-4 in FIG. 3, a locking element of the locking device being disengaged from a locking element receiver of the locking device.

As can be gathered, in particular from FIG. 3, a plane of symmetry for the locking element receiver 122 and the receiver channel 132 in the first embodiment of the drawer guide 100 is the vertically oriented plane 142. This plane 142 furthermore forms a plane of symmetry for two receiver portions 144 of the locking element receiver 122.

The plane 142 extends parallel to the pull-out direction 112.

The relative movement path 140 of the locking elements 124 runs in the plane 142 through the receiver channel 132, so, in a locked state of the locking device 120, in which a locking element 124 is received in the locking element receiver 122, the locking element 124 is engaged with the receiver portions 144 of the locking element receiver 122 at mutually opposite sides of the locking element 124 with respect to the plane 142.

The tong element 130 of the locking element receiver 122 has two slot-like recesses 146 in the receiver portions 144, which run parallel to the pull-out direction 112 (see FIG. 2).

It is made possible by means of the slot-like recesses 146 for the receiver portions 144, at least in the locked state, in which a locking element 124 is received in the locking element receiver 122, to not be pivoted about an axis running parallel to the pull-out direction 112 in order to clamp the locking element between the receiver portions 144. Rather, it is made possible by means of the slot-like recesses 146 for the receiver portions 144 to move in substantially opposite directions in central regions 148, with respect to the pull-out direction 112, of the receiver portions 144. Therefore, the forces exerted by means of the locking element receiver 122 on the locking element 124 on both sides are at least approximately directed in opposite directions to one another.

Figure 5:
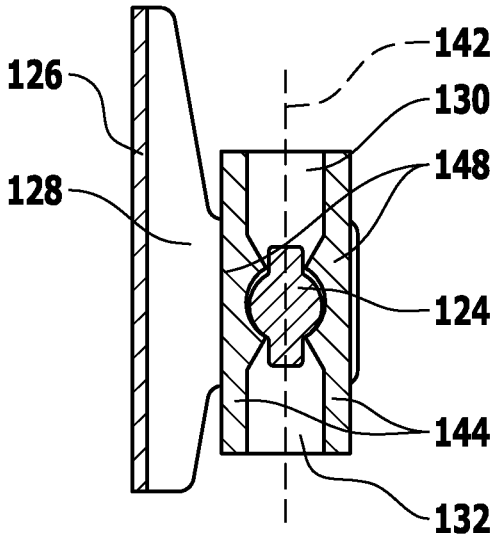
FIG. 5 shows a schematic view, corresponding to FIG. 4, of the locking device of the drawer guide from FIG. 1, the locking element being engaged with the locking element receiver.
Figure 6:
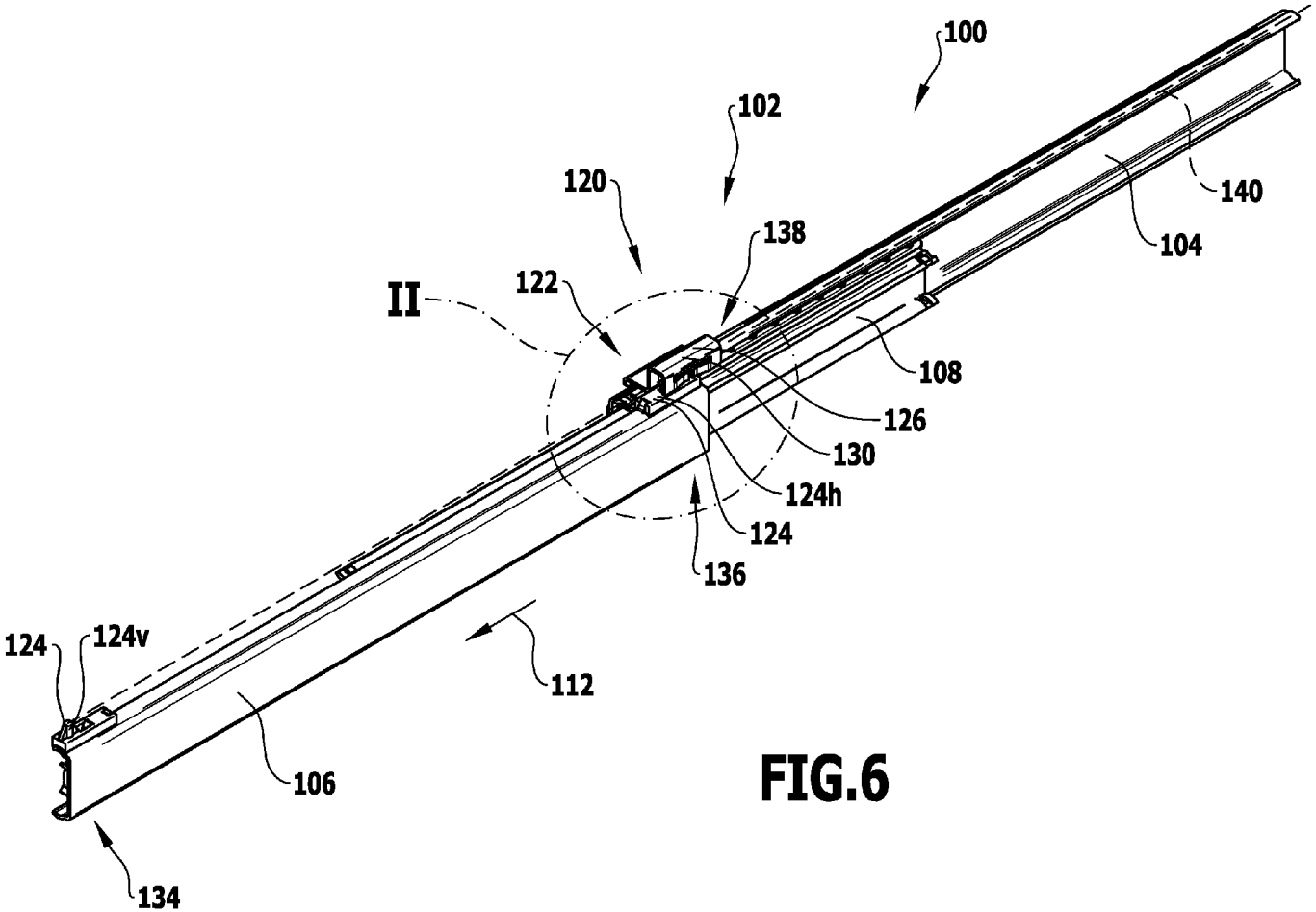
FIG. 6 shows a schematic perspective view, corresponding to FIG. 1, of a second embodiment of a drawer guide, in which a locking element receiver, configured as a sheet metal bent part, of a locking device is provided.
Figure 7:
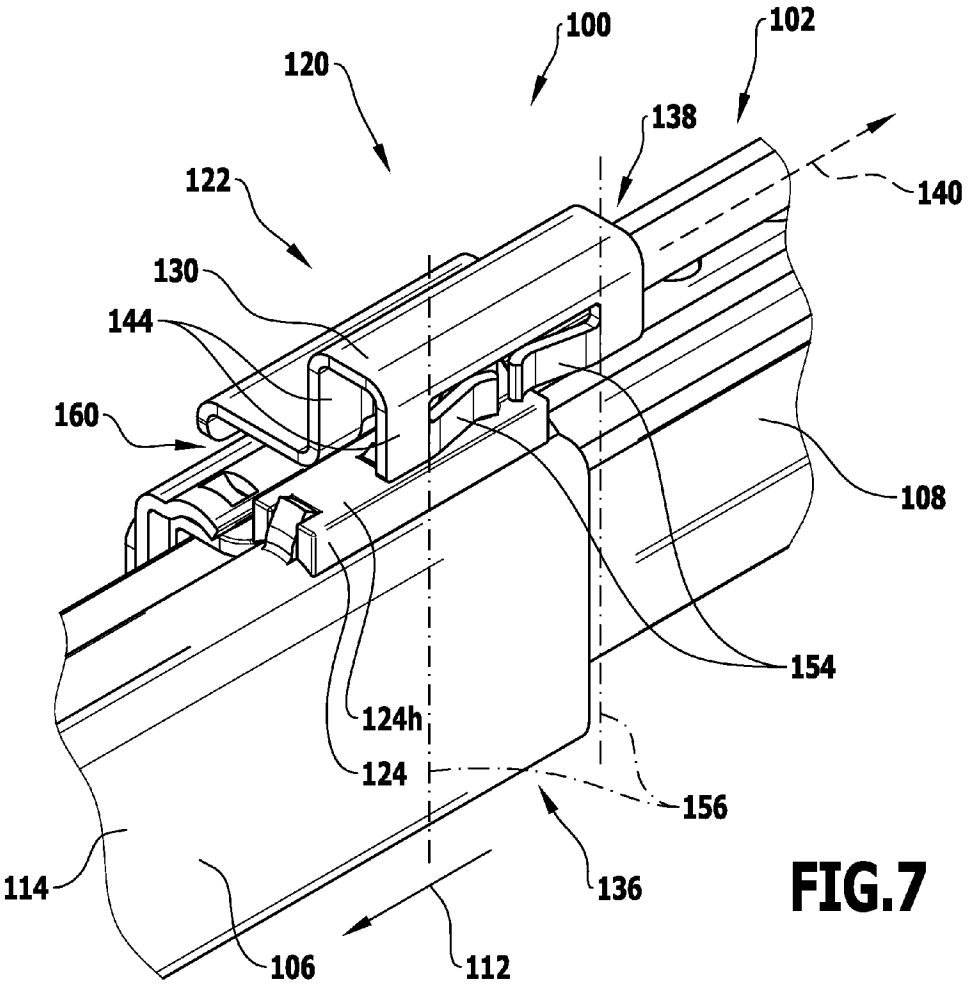
FIG. 7 shows an enlarged view of the region II in FIG. 6.
Figure 8:
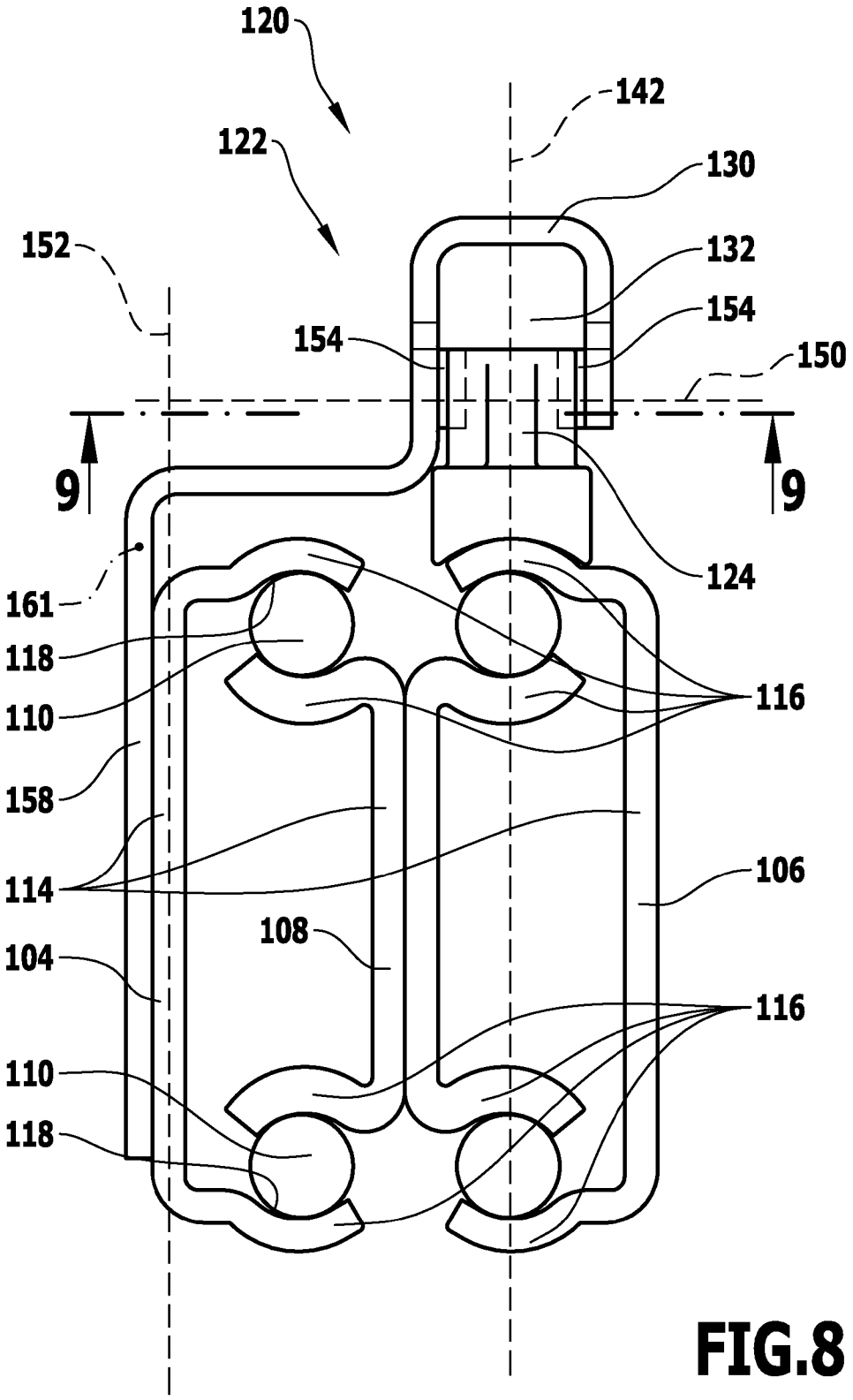
FIG. 8 shows a schematic view, corresponding to FIG. 3, of a vertical cross-section through the drawer guide from FIG. 6.

As can be gathered, in particular from FIG. 3 and FIG. 5, the central regions 148 of the receiver portions 144 of the locking element receiver 122 are moved along directions running in a movement plane 150 in order to be able to receive the locking element 124 between the central regions 148 of the receiver portions 144 of the locking element receiver 122, in particular in a shape-locking manner, for example, in a receiving space 162, which is cylindrical in portions.

The movement plane 150 is oriented here perpendicularly to the plane 142 predetermined by the receiver channel 132.

Furthermore, the movement plane 150 in the first embodiment of the drawer guide 100 shown in FIG. 1 is oriented perpendicularly to the rail planes 152, along which the rail backs 114 of the guide rails 102 of the drawer guide 100 extend.

The first embodiment of the drawer guide 100 described above functions as follows:

In an assembled state of the drawer guide 100, in which a drawer is displaceably arranged on a carcass by means of the drawer guide 100, the drawer guide 100 is, for example, arranged in a completely inserted state, in which the front locking element **124*v* is engaged with the locking element receiver 122 and therefore the drawer-side guide rail 106 is locked relative to the carcass-side guide rail 104 in relation to the pull-out direction 112**.

If a user pulls the drawer out of the carcass, the drawer-side guide rail 106 is moved relative to the carcass-side guide rail 104, so the front locking element **124*v* disengages from the locking element receiver 122**.

In connection therewith, the rear locking element **124*h* is moved along the relative movement path 140 of the rear locking element 124*h* in the direction of the locking element receiver 122 and finally, on reaching the completely pulled-out state of the drawer guide 100, is made to engage with the locking element receiver 122**.

The locking element 124*h* is received between the central regions 148 of the receiver portions 144 of the locking element receiver 122, so these central regions 148 are moved away from one another in directions running along the movement plane 150.

Due to the material, a restoring force is exerted by the central regions 148 on the locking element 124, in each case, owing to the deflection of the central regions 148 of the receiver portions 144 of the locking element receiver 122, so the locking element 124 is held in the locked position.

By a suitable selection of the materials or dimensions of the tong element 130 and/or the locking elements 124, a locking force, which has to be overcome to make the locking element engage with the locking element receiver, can be selected in a targeted manner. A clamping force, which is exerted, in the locked state of the drawer guide, by the locking element receiver on the locking element received therein and/or a release force, which has to be overcome to disengage the locking element from the locking element receiver, can also be adjusted in a targeted manner.

In particular, different locking forces, different clamping forces and/or different release forces can be adjusted for different locking states.

A second embodiment of a drawer guide 100 shown in FIGS. 6 to 11 differs from the first embodiment shown in FIGS. 1 to 5 substantially in that the locking element receiver 122 is formed in one piece as a sheet metal bent product and therefore no separate tong element 130 is provided. Rather, the holding element 126 is formed in one piece with the tong element 130 from a metallic material.

Furthermore, no continuous central region 148 of the receiver portions 144 of the locking element receiver 122 is provided in the second embodiment of the drawer guide 100. Rather, the locking element receiver 122 according to the second embodiment of the drawer guide 100 comprises four spring elements 154, which are arranged pairwise on both sides of the plane 142 and are resiliently pivotable about pivot axes 156 running substantially vertically and therefore perpendicularly to the pull-out direction 112.

Because of the resiliently pivotable configuration of the spring elements 154 about the pivot axes 156, the spring elements 154 are also movable in directions running along the movement plane 150.

Therefore, no restoring forces oriented transversely to the movement plane 150 are exerted on the locking element 124 by means of the spring elements 154 in the locked state of a locking element 124 in the locking element receiver 122.

Figure 9:
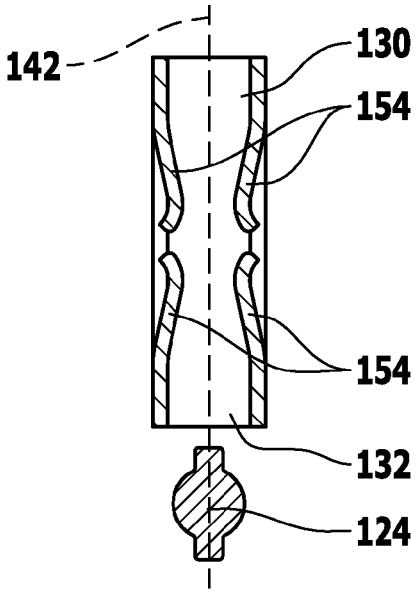
FIG. 9 shows a schematic view, corresponding to FIG. 4, of a horizontal section through the locking device of the drawer guide from FIG. 6, a locking element of the locking device being disengaged from a locking element receiver of the locking device.
Figure 10:
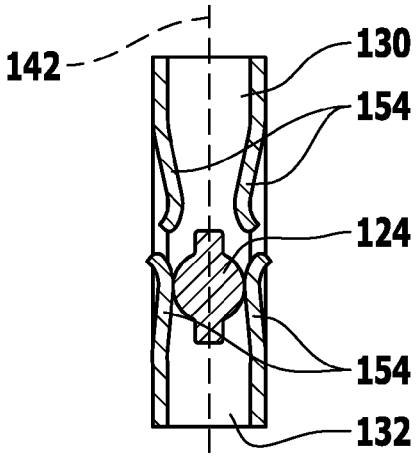
FIG. 10 shows a schematic view, corresponding to FIG. 9, of the locking device of the drawer guide from FIG. 6, the locking element of the locking device, to achieve a locked state, being clamped in between two receiver portions of the locking element receiver of the locking device.
Figure 11:
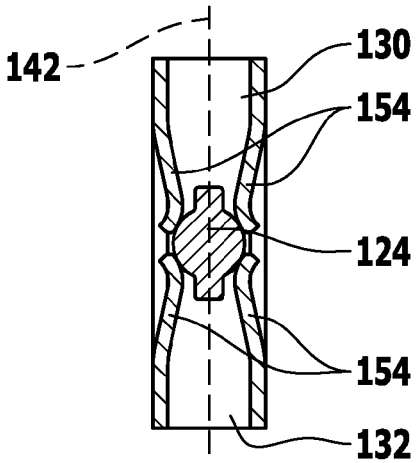
FIG. 11 shows a schematic view, corresponding to FIG. 9, of the locking device of the drawer guide from FIG. 6, the locking element being engaged with the locking element receiver in the locked state.

As can be gathered, in particular from FIGS. 9 to 11, in particular a locking element 124 that is cylindrical at least in portions can be received particularly easily in the locking element receiver 122 according to the second embodiment of the drawer guide 100.

One difference between the locking element receiver 122 according to the second embodiment of the drawer guide 100 and the locking element receiver 122 according to the first embodiment of the drawer guide 100 is that in the second embodiment of the drawer guide 100, the locking element receiver 122 is provided in a region between a fastening portion 158, in which the locking element receiver 122 is fastened on the rail back 144 of the carcass-side rail 104, and a portion, which forms the tong element 130, of the locking element receiver 122 with an indentation 160.

This indentation 160 leads to a narrow material point, which in turn leads to the fact that the portion of the locking element receiver 122 forming the tong element 130 is pivotable about an axis 161 running substantially perpendicularly to the pull-out direction 112 because of the inherent elasticity of the locking element receiver 122. Tolerances in the production of the drawer guide 100 can thus be compensated in order to always be able to receive a locking element 124 centrally in the receiver channel 132.

Otherwise, the second embodiment of the drawer guide 100 shown in FIGS. 6 to 11 coincides with respect to structure and function to the first embodiment shown in FIGS. 1 to 5, so reference is in this respect made to the above description thereof.

Figure 12:
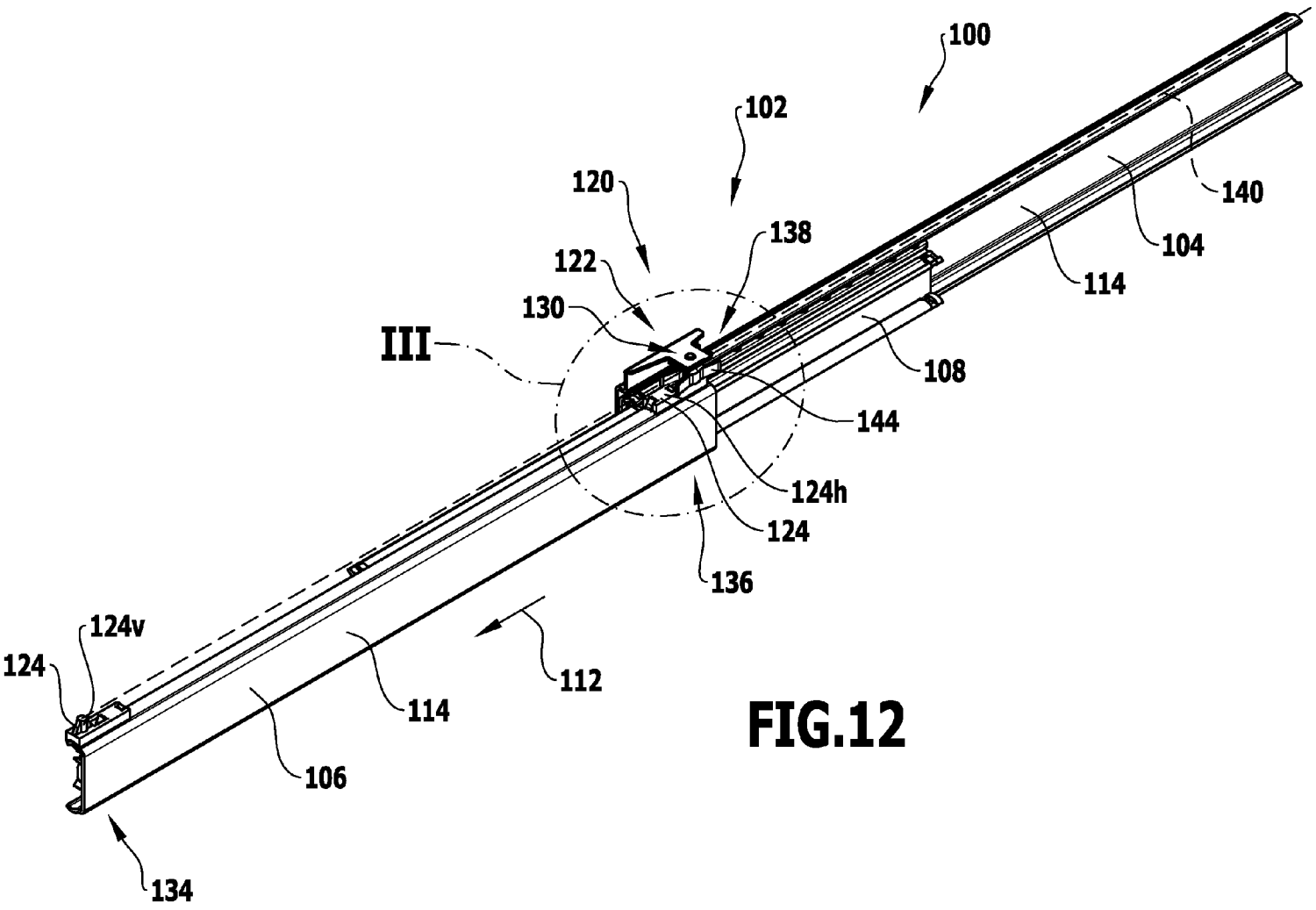
FIG. 12 shows a schematic perspective view, corresponding to FIG. 1, of a third embodiment of a drawer guide, in which a multi-part locking element receiver formed from metallic components is provided.
Figure 13:
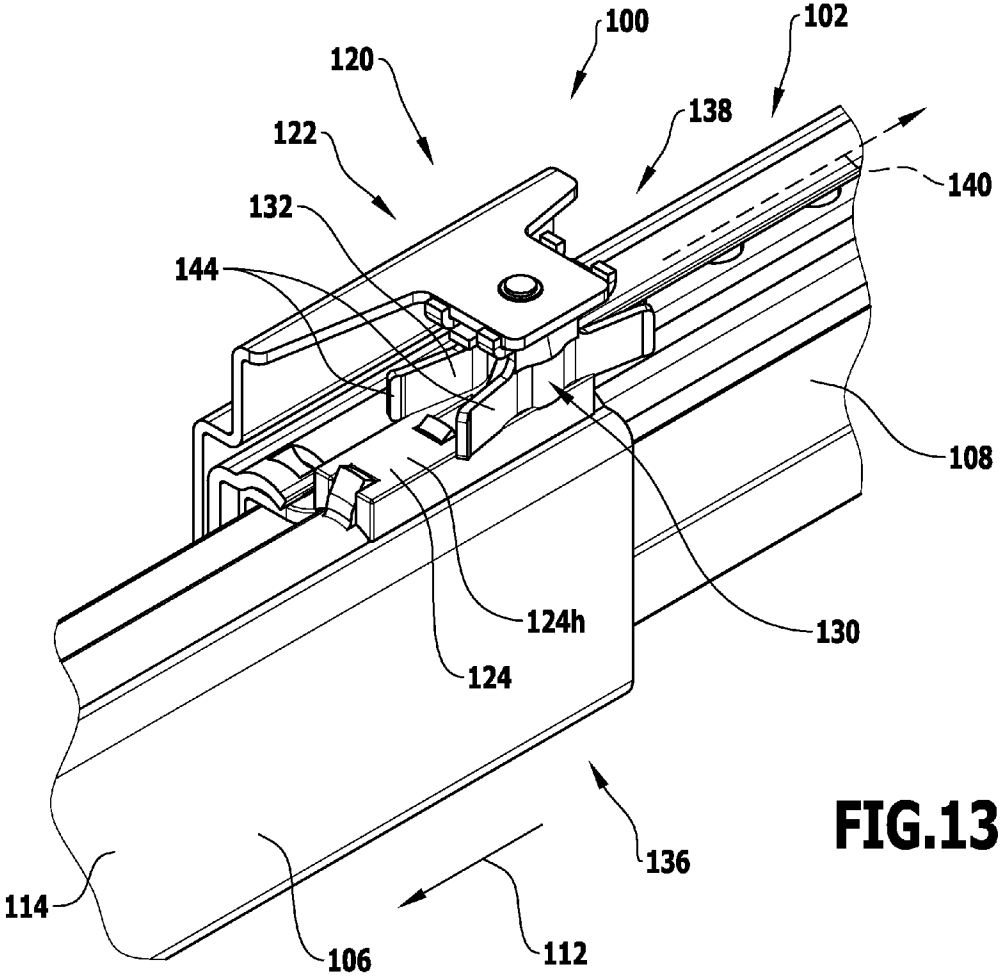
FIG. 13 shows an enlarged view of the region III from FIG. 12.
Figure 14:
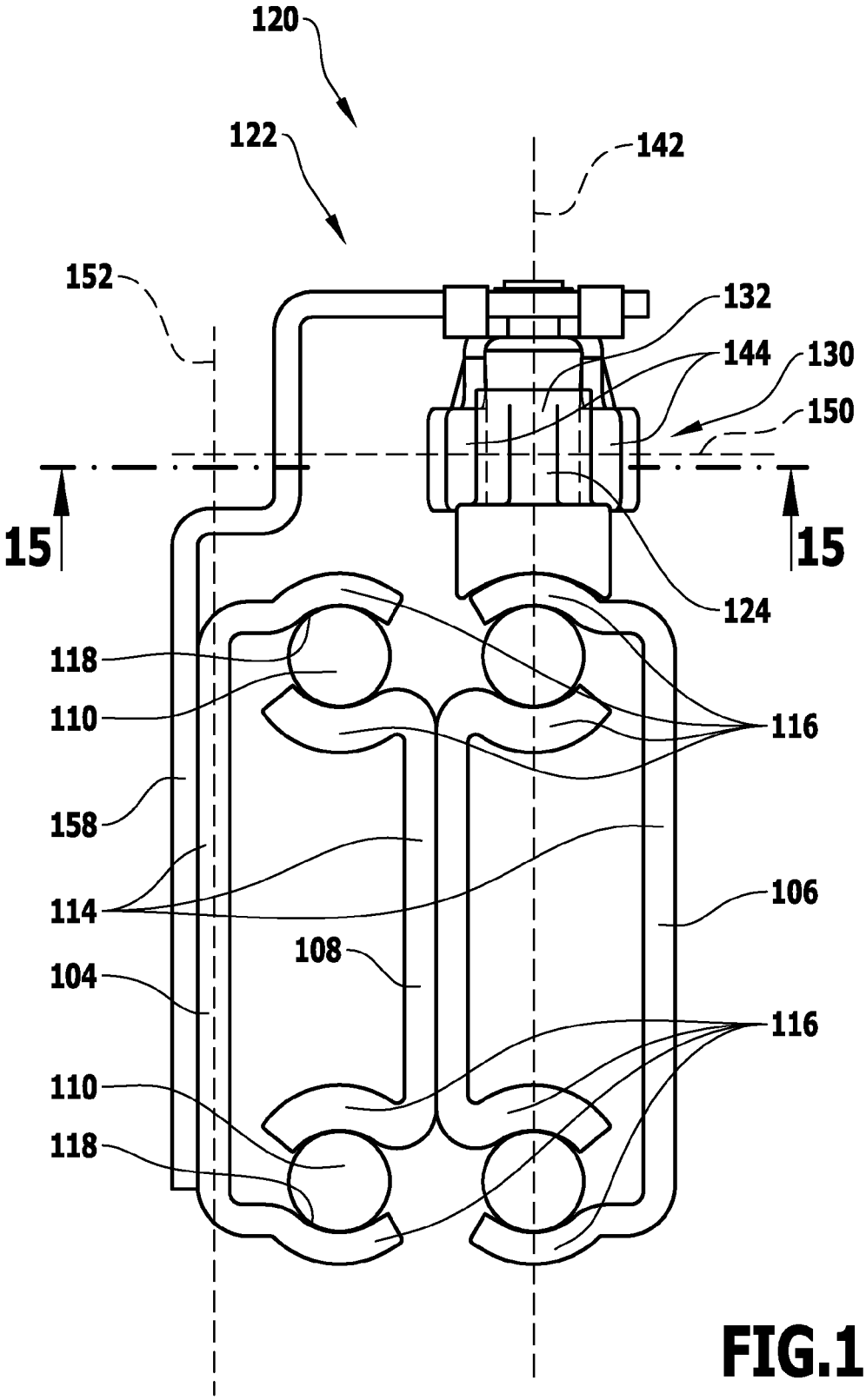
FIG. 14 shows a schematic view, corresponding to FIG. 3, of a vertical cross-section through the drawer guide form FIG. 12.
Figure 15:
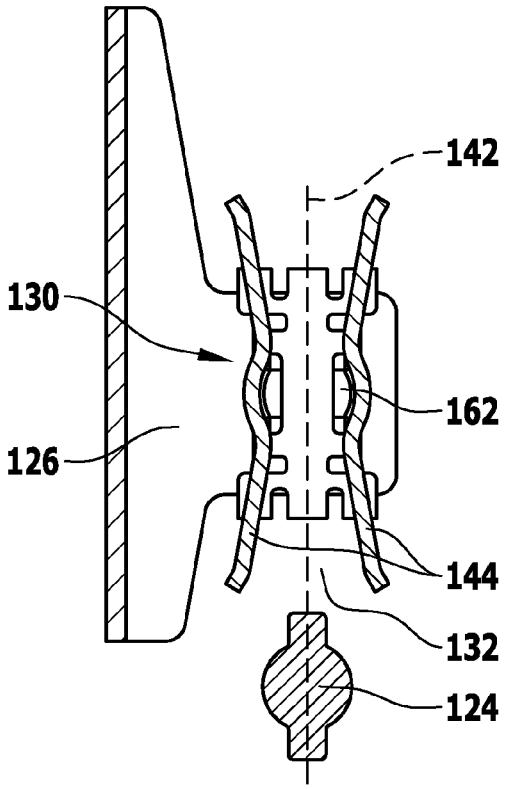
FIG. 15 shows a schematic view, corresponding to FIG. 4, of a horizontal cross-section through the locking device of the drawer guide from FIG. 12, a locking element of the locking device being disengaged from a locking element receiver of the locking device.
Figure 16:
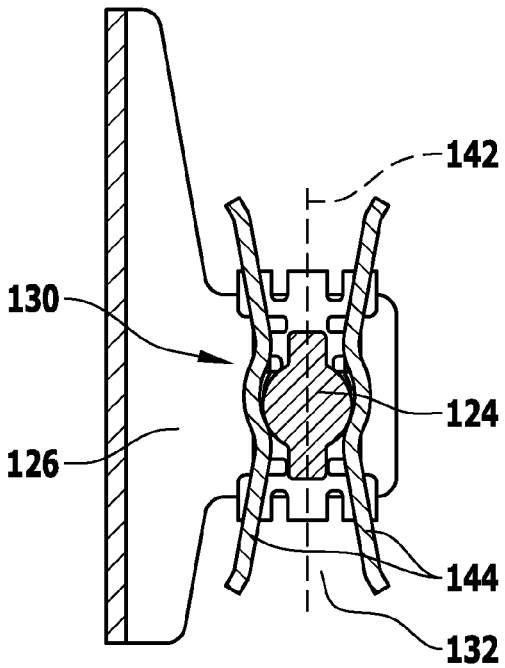
FIG. 16 shows a schematic view, corresponding to FIG. 15, of the locking device of the drawer guide from FIG. 12, the locking element being engaged with the locking element receiver.

A third embodiment of a drawer guide 100 shown in FIG. 12 differs from the first embodiment shown in FIGS. 1 to 5 substantially in that the tong element 130 is formed from a metallic material and therefore comprises two metallic receiver portions 144.

The receiver portions 144 are configured here in such a way that the receiver channel 132 of the locking element receiver 122 forms a receiving space 162 which is cylindrical in portions and in which a locking element 124, which is cylindrical in portions, can be received particularly easily and securely.

With regard to the pull-out direction 112 before and after the receiving space 162, which is cylindrical in portions, the receiver channel 132 widens in order to be able, particularly easily and specifically, to feed a locking element 124 to be fed to the receiver channel 132 to the receiving space 162 which is cylindrical in portions.

Otherwise, the third embodiment of the drawer guide 100 shown in FIGS. 12 to 16 coincides with respect to structure and function to the first embodiment shown in FIGS. 1 to 5, so reference is made in this respect to the above description thereof.

Figure 17:
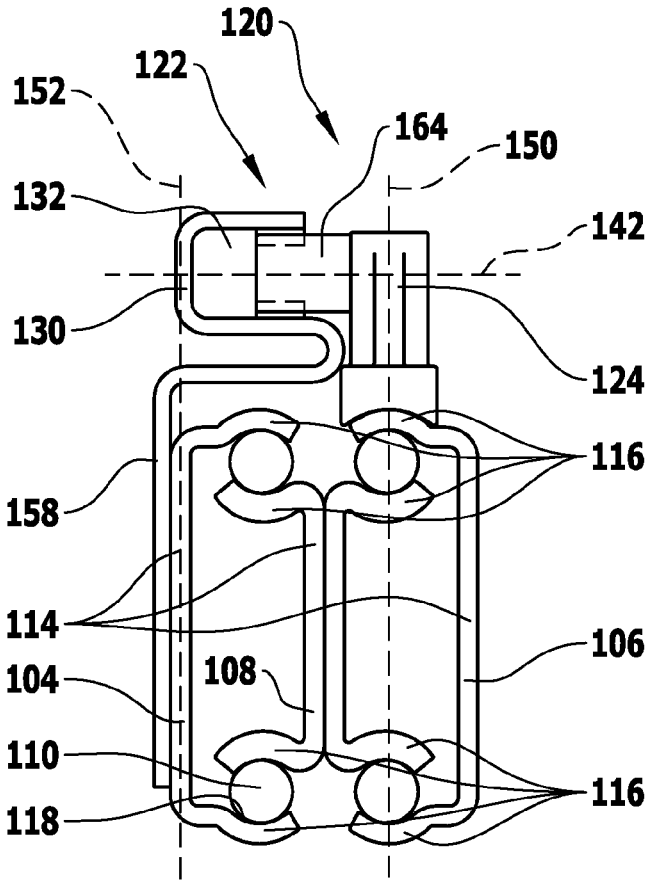
FIG. 17 shows a schematic view, corresponding to FIG. 3, of a vertical cross-section through a fourth embodiment of a drawer guide, in which a locking element projecting laterally into a locking element receiver is provided.

A fourth embodiment of a drawer guide 100 shown in FIG. 17 differs from the second embodiment shown in FIGS. 6 to 11 substantially in that the receiver channel 132 of the locking element receiver 122 opens toward one side and therefore the plane 142 is oriented substantially horizontally.

Consequently, the movement plane 150, along which the directions run, in which the receiver portions 144 of the locking element receiver 122 are movable, is substantially vertically oriented and therefore arranged substantially parallel to the rail planes 152.

In connection therewith, the locking elements 124 comprise a portion 164 projecting away laterally, with which the respective locking element 124 is configured to be brought into engagement with the locking element receiver 122

Otherwise, the fourth embodiment of the drawer guide 100 shown in FIG. 17 coincides with respect to structure and function to the second embodiment shown in FIGS. 6 to 11, so reference is made in this respect to the above description thereof.

Figure 18:
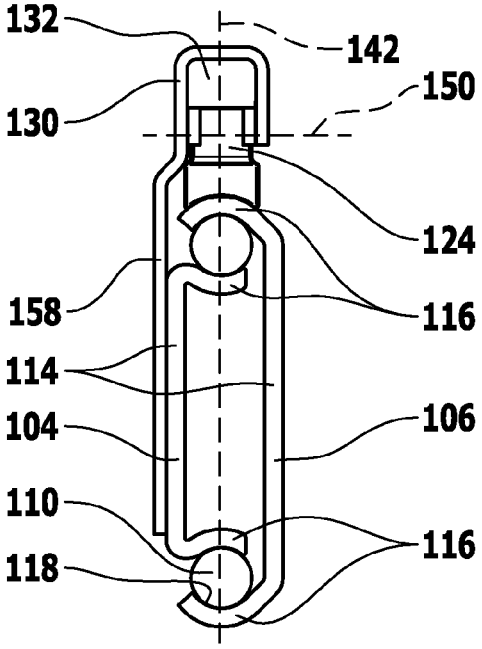
FIG. 18 shows a schematic view, corresponding to FIG. 3, of a vertical cross-section through a fifth embodiment of a drawer guide, in which only two guide rails are provided.

A fifth embodiment of a drawer guide 100 shown in FIG. 18 differs from the second embodiment shown in FIGS. 6 to 11 substantially in that the drawer guide 100 merely comprises a drawer-side guide rail 106 and a carcass-side guide rail 104 and no centre rail is provided.

The fifth embodiment of the drawer guide 100 shown in FIG. 18 is therefore not a full-extension mechanism but a partial extension mechanism.

Otherwise, the fifth embodiment of the drawer guide 100 shown in FIG. 18 coincides with respect to structure and function to the second embodiment shown in FIGS. 6 to 11, so reference is in this respect made to the above description thereof.

Since, in all the embodiments of the drawer guide 100, at least one locking element receiver 122 comprises at least two receiver portions 144, between which at least one locking element 124 is configured to be received, at least two receiver portions 144 being arranged on mutually opposing sides of the relative movement path 140 with respect to the relative movement path 140 of at least one locking element 124 relative to at least one locking element receiver 122, a particularly secure locking of the drawer-side guide rail 106 relative to the carcass-side guide rail 104 with respect to the pull-out direction 112 can take place, so a drawer arranged by means of a drawer guide 100 of this type on a carcass can be configured in a particularly user-friendly manner.

Other advantageous embodiments are the following:

1. Drawer guide for displaceably arranging, on a carcass, a drawer configured to be pulled out of the carcass in a pull-out direction (112), comprising at least two guide rails (102), which are displaceable relative to one another, and an externally mounted locking device (120) for locking at least one of the at least two guide rails (102) relative to at least one further one of the at least two guide rails (102) with respect to the pull-out direction (112) in at least one position, wherein the locking device (120) comprises at least one locking element (124) and at least one locking element receiver (122) to receive the at least one locking element (124), which are arranged on guide rails (102) of the drawer guide (100), which are different from one another, characterised in that at least one locking element receiver (122) comprises at least two receiver portions (144), between which at least one locking element (124) is receivable in a locked state of the drawer guide (100), at least two receiver portions (144) being arranged, with respect to a relative movement path (140) of at least one locking element (124), on mutually opposite sides of the relative movement path (140) relative to at least one locking element receiver (122).

2. Drawer guide according to embodiment 1, characterised in that at least one locking element (124) is movably arranged on one of the guide rails (102) in a direction running transversely to the pull-out direction (112).

3. Drawer guide according to either of embodiments 1 or 2, characterised in that at least one locking element (124) is formed from a material that is different from the material of the guide rails (102).

4. Drawer guide according to any one of embodiments 1 to 3, characterised in that at least one locking element receiver (122) is movably arranged on one of the guide rails (102) in a direction running transversely to the pull-out direction (112).

5. Drawer guide according to any one of embodiments 1 to 4, characterised in that at least one locking element receiver (122) is arranged on a rail back (114) of a guide rail (102), which rail back (114) connects two legs (116) of the guide rail (102) to one another, said legs (116) in each case having a rolling element track (118).

6. Drawer guide according to any one of embodiments 1 to 5, characterised in that at least one locking element (124) is arranged on a leg (116), which has a rolling element track (118), of a substantially C-shaped guide rail (102).

7. Drawer guide according to any one of embodiments 1 to 6, characterised in that at least one locking element receiver (122) is formed in one piece.

8. Drawer guide according to any one of embodiments 1 to 7, characterised in that at least one locking element receiver (122) is formed as a metal sheet bent product.

9. Drawer guide according to any one of embodiments 1 to 8, characterised in that at least one locking element (124) and at least one locking element receiver (122) are arranged on at least two of the guide rails (102) in such a way that the drawer guide (100) is lockable in an at least approximately completely pulled-out position and/or in an at least approximately completely inserted position.

10. Drawer guide according to any one of embodiments 1 to 9, characterised in that at least one locking element (124) is arranged on a carcass-side guide rail (104) or on a drawer-side guide rail (106) and in that at least one locking element receiver (122) is arranged respectively on a drawer-side guide rail (106) or on a carcass-side guide rail (104).

11. Drawer guide according to any one of embodiments 1 to 10, characterised in that at least one receiver portion (144) of at least one locking element receiver (122) is resiliently pivotable about an axis (156), which runs at least approximately perpendicularly to the pull-out direction (112).

12. Drawer guide according to any one of embodiments 1 to 11, characterised in that at least two receiver portions (144), which are arranged mutually opposite with respect to a relative movement path (140) of at least one locking element (124), of at least one locking element receiver (122) are in each case pivotable about an axis (156), the axes (156) running at least approximately parallel to one another.

13. Drawer guide according to any one of embodiments 1 to 12, characterised in that at least two receiver portions (144), which are arranged mutually opposite with respect to a relative movement path (140) of at least one locking element (124), of at least one locking element receiver (122), to receive at least one locking element (124), are movable at least approximately along directions running in the same plane.

14. Drawer guide according to embodiment 13, characterised in that at least two receiver portions (144), which are arranged mutually opposite with respect to a relative movement path (140) of at least one locking element (124), of at least one locking element receiver (122), to receive at least one locking element (124), are movable at least approximately along directions running in a common movement plane (150), the movement plane (150) running at least approximately perpendicularly to a rail plane (152), along which a rail back (114) of a C-shaped guide rail (102) extends.

15. Drawer guide according to any one of embodiments 1 to 14, characterised in that at least two locking elements (124) and/or at least two locking element receivers (122) are provided, which differ from one another with regard to a locking force necessary to achieve the locked state of the drawer guide (100) and/or with respect to a clamping force acting in the locked state of the drawer guide (100) and/or with respect to a release force necessary for the release of the locked state of the drawer guide (100).

The invention claimed is:

1. Drawer guide for displaceably arranging, on a carcass, a drawer configured to be pulled out of the carcass in a pull-out direction, comprising:

at least two guide rails, which are displaceable relative to one another, and an externally mounted locking device for locking at least one of the at least two guide rails relative to at least one further one of the at least two guide rails with respect to the pull-out direction in at least one position, the locking device comprising at least one locking element and at least one locking element receiver to receive the at least one locking element, which are arranged on respective guide rails of the drawer guide which are different from one another, wherein:

the at least one locking element receiver comprises at least two receiver portions, between which the at least one locking element is receivable in a locked state of the drawer guide, the at least two receiver portions being arranged, with respect to a relative movement path of the at least one locking element, on mutually opposite sides of the relative movement path relative to the at least one locking element receiver, each of the respective guide rails comprises a substantially C-shaped guide rail formed by a rail back connecting two legs of the guide rail to one another, each leg having a rolling element track, the rail back and the two legs surround an inner space of the substantially C-shaped guide rails, and the at least one locking element and the at least one locking element receiver are arranged on an outside of the respective guide rail with respect to the inner space.

2. Drawer guide according to claim 1, wherein the at least one locking element is movably arranged on one of the guide rails in a direction running transversely to the pull-out direction.

3. Drawer guide according to claim 1, wherein the at least one locking element is formed from a material that is different from a material of the guide rails.

4. Drawer guide according to claim 1, wherein the at least one locking element receiver is movably arranged on one of the guide rails in a direction running transversely to the pull-out direction.

5. Drawer guide according to claim 1, wherein the at least one locking element receiver is arranged on the rail back of the respective guide rail.

6. Drawer guide according to claim 1, wherein the at least one locking element is arranged on one of the two legs.

7. Drawer guide according to claim 1, wherein the at least one locking element receiver is formed in one piece.

8. Drawer guide according to claim 1, wherein the at least one locking element receiver is formed as a metal sheet bent product.

9. Drawer guide according to claim 1, wherein the at least one locking element and the at least one locking element receiver are arranged on at least two of the guide rails in such a way that the drawer guide is lockable in at least one of an at least approximately completely pulled-out position and an at least approximately completely inserted position.

10. Drawer guide according to claim 1, wherein:

the at least one locking element is arranged on a carcass-side guide rail or on a drawer-side guide rail, and the at least one locking element receiver is arranged respectively on a drawer-side guide rail or on a carcass-side guide rail.

11. Drawer guide according to claim 1, wherein at least one of the at least two receiver portions of the at least one locking element receiver is resiliently pivotable about an axis, which runs at least approximately perpendicularly to the pull-out direction.

12. Drawer guide according to claim 1, wherein the at least two receiver portions, which are arranged mutually opposite with respect to the relative movement path of the at least one locking element, are in each case pivotable about a respective axis, the respective axes running at least approximately parallel to one another.

13. Drawer guide according to claim 1, wherein the at least two receiver portions, which are arranged mutually opposite with respect to the relative movement path of the at least one locking element, to receive the at least one locking element, are movable at least approximately along directions running in a same plane.

14. Drawer guide according to claim 13, wherein the at least two receiver portions, which are arranged mutually opposite with respect to the relative movement path of the at least one locking element, to receive at least one locking element, are movable at least approximately along directions running in a common movement plane, the movement plane running at least approximately perpendicularly to a rail plane, along which the rail back of the respective guide rail extends.

15. Drawer guide according to claim 1, wherein the at least one locking element comprises two locking elements, which differ from one another with regard to at least one of a locking force necessary to achieve the locked state of the drawer guide, a clamping force acting in the locked state of the drawer guide, and a release force necessary for a release of the locked state of the drawer guide.

* * * * *